US005184142A

United States Patent [19]

Hornburg et al.

[11] Patent Number: 5,184,142

[45] Date of Patent: Feb. 2, 1993

[54] AUTOMOTIVE VEHICLE ANTENNA

[76] Inventors: Kurt P. Hornburg, 21W732 Glen Valley Dr.; Wayne A. Thelen; William Thelen, both of 21W722Glen Valley Dr., all of Glen Ellyn, Ill. 60137

[21] Appl. No.: 609,439

[22] Filed: Nov. 5, 1990

[51] Int. Cl.[5] ..... H01Q 1/100; H01Q 1/400; H01Q 1/120

[52] U.S. Cl. ..... 343/715; 343/882; 343/888; 343/873

[58] Field of Search ..... 343/DIG. 1, 715, 900, 343/888, 872, 873, 882, 702, 722, 880, 714; 248/514, 515, 535, 539-541; 403/92, 93, 98; 52/110

[56] References Cited

U.S. PATENT DOCUMENTS

| | | | |
|---|---|---|---|
| 2,329,200 | 9/1943 | Hefele | 343/900 |
| 2,367,164 | 1/1945 | Yerger, Jr. | 343/714 |
| 3,191,898 | 6/1965 | McCullough | 343/888 |
| 3,665,477 | 5/1972 | Budrow et al. | 343/714 |
| 4,047,779 | 9/1977 | Klancnik | 339/9 A |
| 4,089,817 | 5/1978 | Kirkendall | 343/713 |
| 4,097,867 | 6/1978 | Eroncig | 343/715 |
| 4,101,897 | 7/1978 | Morrison | 343/715 |
| 4,109,251 | 8/1978 | MacDougall | 343/715 |
| 4,115,779 | 9/1978 | Dantzler et al. | 343/715 |
| 4,161,737 | 7/1979 | Albright | 343/749 |
| 4,223,314 | 9/1980 | Tyrey et al. | 343/715 |
| 4,238,799 | 12/1980 | Parfitt | 343/715 |
| 4,266,227 | 5/1981 | Blaese | 343/715 |
| 4,546,949 | 10/1985 | Millet et al. | 343/715 |
| 4,621,243 | 11/1986 | Harada | 333/24 R |
| 4,779,098 | 10/1988 | Blaese | 343/715 |
| 4,785,305 | 11/1988 | Shyu | 343/713 |
| 4,794,319 | 12/1988 | Shimazaki | 343/715 |
| 4,825,217 | 4/1989 | Choi | 343/715 |
| 4,882,592 | 11/1989 | Studer, Jr. et al. | 343/715 |
| 4,914,450 | 4/1990 | Dilley et al. | 343/895 |
| 4,916,456 | 4/1990 | Shyu | 343/713 |
| 4,931,805 | 6/1990 | Fisher | 343/715 |
| 4,931,806 | 6/1990 | Wunderlich | 343/715 |

FOREIGN PATENT DOCUMENTS

| | | | |
|---|---|---|---|
| 3611881 | 10/1987 | Fed. Rep. of Germany . | |
| 3837784 | 10/1989 | Fed. Rep. of Germany . | |
| 2246986 | 6/1975 | France | 343/715 |
| 0100003 | 5/1986 | Japan . | |
| 0136904 | 6/1987 | Japan . | |
| 0059005 | 3/1988 | Japan . | |
| 2046529 | 11/1980 | United Kingdom | 343/715 |

*Primary Examiner*—Rolf Hille
*Assistant Examiner*—Peter Toby Brown
*Attorney, Agent, or Firm*—Varnum, Riddering, Schmidt & Howlett

[57] ABSTRACT

An automotive vehicle antenna comprises an outer cover having a cross section elongated in the direction of travel of the vehicle. The cover, which includes an enlarged section covering a loading coil, strengthens the antenna against bending due to wind force and presents a low wind resistance profile. The antenna may be window mounted and is provided with a conductive base engaging a conductive pivot support. The antenna may be pivoted to a flattened position to avoid damage by objects such as may be encountered in an automatic carwash. The antenna may be adjusted to a precise upright position for optimum reception and is adapted to return to a previously adjusted position when it is returned to the upright position from a flattened position.

20 Claims, 7 Drawing Sheets

AUTOMOTIVE VEHICLE ANTENNA

BACKGROUND OF THE INVENTION

The invention relates to antennas and more particularly to antennas for use on automotive vehicles such as those used in mobile radio communications.

Automobile antennas, especially those used for cellular mobile radios are commonly lightweight wire antennas designed to operate generally in the 800 to 900 MHz frequency range. Such an antenna may include a coil section referred to as a loading coil connected between substantially straight upper and lower sections. A problem with such antennas is that they tend to bend due to wind force when the vehicle reaches higher speeds. The frequency characteristics of the antenna are determined in large measure by its length and bending of the antenna tends to change its effective length and diminish significantly its efficiency.

Another problem with such antennas having load coils, is that the coil produces an annoying whistle at higher speeds of the vehicle. The coils further tend to be unsightly and there is a need for an aesthetically pleasing antenna design which overcomes the disadvantages of antennas currently on the market.

Furthermore, automobile antennas and particularly mobile radio antennas are prone to be damaged when they are bumped or bent. Such antennas are commonly fastened to a metal part of the car or a window glass in a semipermanent fashion so that they are not readily removed or retracted. Automatic carwashes are of a special concern since they often cause damage to mobile radio antennas.

SUMMARY OF THE INVENTION

These and other problems of the prior art are overcome by providing the antenna with a preformed shape having an elongated cross section with a relatively longer longitudinal dimension in the direction of travel of the vehicle and a relatively shorter transverse dimension in a direction transverse to the direction of travel, thereby providing resistance to bending in the direction of travel while presenting a low wind resistance profile. Furthermore, the problem of prior art devices may be overcome by encasing the antenna, including its loading coil, in a nonconductive covering of elongated cross section with a relatively longer longitudinal dimension in the direction of travel and a relatively shorter transverse dimension, whereby the covering provides resistance to bending along the direction of travel while presenting low wind resistance. Advantageously, the covering lends strength to the antenna to avoid substantial loss of efficiency due to bending in the direction in which bending would normally occur and provides relatively low resistance to wind which causes the bending. Furthermore, the covering avoids the annoying whistle effect generally produced at higher speeds. A further advantage is that the covering provides an aesthetically pleasing form and may be styled in a variety of ways to enhance marketing appeal.

In one particular embodiment of the invention, the antenna is provided with a base connected to an antenna conductive element and a cylindrical collar disposed adjacent to and engaging the base for defining a preferred upright orientation for the antenna. A pivot support pivotally supports the base and the collar and engageably retains the collar in selected rotational orientations. Advantageously, the antenna may be pivoted to a flat position to avoid being damaged by obstacles such as encountered, for example, in automatic carwashers and may be readily returned to a precise upright position defined by engagement of the cylindrical collar with the pivot support. In one particular embodiment, the collar is provided with a plurality of circumferentially spaced-apart indentations, and the pivot support comprises a retractable retaining pin for selectively engaging the indentations. A position adjustment screw extends through a slotted opening in the base and engages a threaded opening in the cylindrical collar to allow for rotational adjustment of the base relative to the collar. Advantageously, a precise upright position may be defined by fractional movement of the base with respect to the collar in the slotted area and the antenna may be brought to the precise upright position by engagement of the retainer pin with an appropriate indentation on the collar.

In another embodiment of the invention, the collar and the base of the antenna are disengageably maintained in rotational position relative to each other by a detent and precise adjustment of the antenna in the vertical direction may be accomplished by rotation of an adjustment screw engaging the circumference of the cylindrical collar. Advantageously, the antenna may be moved to a flattened position by overcoming the force of the detent between the base and the collar while the collar remains in a predefined position and the antenna may be readily returned to a preferred upright position defined by the collar.

In another embodiment of the invention, the antenna is supported by means of a pivot support slidably engaging a pivot support base. An end stop engages one edge of the antenna at a position above the pivot position and another, removable, end stop engages an opposite edge of the antenna above the pivot position. The antenna is allowed to pivot to a flattened position by removal of the removable end stop. A positioning screw is provided for selectively positioning the pivot support on the base to adjust vertical orientation of the antenna by movement of the pivot support relative to the end stops. Advantageously, this arrangement allows the antenna to be moved to a flattened position by removal of an end stop and may be readily returned to a precisely defined position obtained by selective positioning of the pivot support. In one particular embodiment, the end stops are integral to a cover housing for covering the pivot support. The cover housing has a stationary part and a movable part and the removable end stop is formed integral with the movable part. Advantageously, an aesthetically pleasing housing incorporates functional aspects which allow the antenna to be pivoted and returned to a predefined precise position without requiring adjustment each time it is pivoted.

In another embodiment of the invention, the antenna base is pivotally mounted and comprises a curved circumferential surface provided with a plurality of transversely extending grooves. A retractable position pin is provided with a concave curved end surface having a plurality of grooves for engaging grooves of the antenna base. Advantageously, the antenna may be readily adjusted to a number of desired upright orientations by temporarily retracting the pin. A large area of engagement between the end surface of the pin and the base may be obtained by means of a plurality of engaging grooves on the base and the end surface. The end surface may be forced in close contact with the base by the force of a spring applied to the retractable pin.

BRIEF DESCRIPTION OF THE DRAWING

An illustrative embodiment of the invention is described with reference to the accompanying drawing in which.

DETAILED DESCRIPTION

Figure 1:
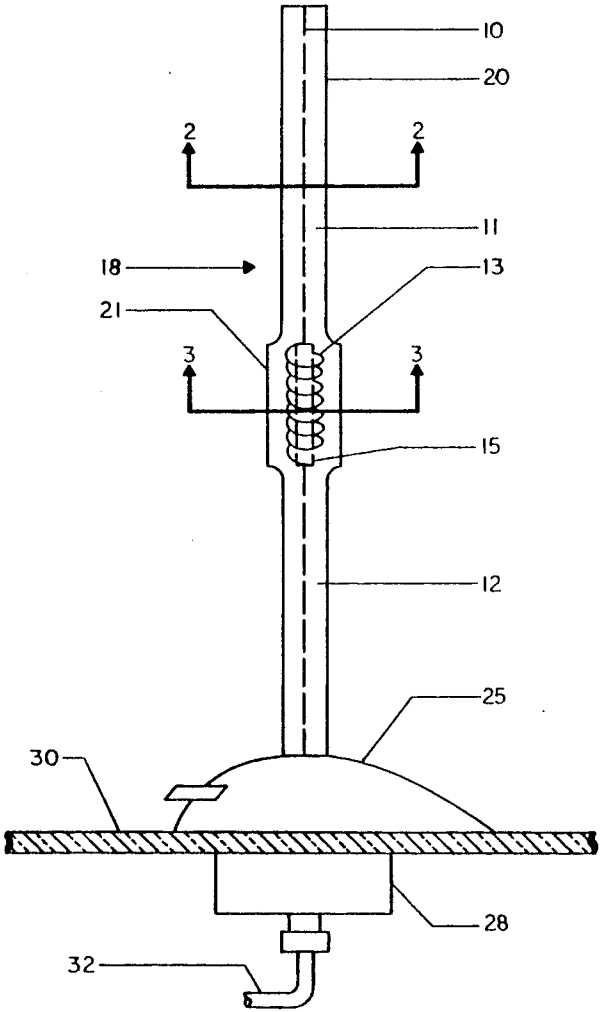
FIG. 1 is a side elevation of an antenna embodying principles of the invention.

FIG. 1 represents a side elevation of an antenna assembly embodying principles of the invention. The antenna 18 includes a conductive antenna element 10 having substantially straight upper and lower sections 11 and 12, respectively, and a loading coil 13 connected between the sections 11 and 12. The antenna element 10 may, for example, be a cellular mobile radio antenna. The antenna element 10 is encased in a molded plastic cover 20 having an expanded section 21 to accommodate loading coil 13. The molded cover may be formed from any of a number of commercially available electrically insulating plastic materials so as to provide a relatively rigid outer cover for the antenna element 10. The purpose of the plastic cover is to prevent bending while presenting a minimal wind resistance, and to eliminate annoying coil whistle. While the cover 20, as shown in FIG. 1, extends over the entire length of the conductive element, a partial cover, e.g., one not covering the upper conductive section 11, will provide many of the same benefits since much of the bending usually occurs at or below the loading coil 13. Further shown in FIG. 1 internal to the loading coil 13 is a core 15. The core 15 may be a hollow tube of appropriate diameter to fit inside the coil, having closed ends and nonconductive surfaces. The core 15 is inserted in the coil 13 prior to forming the cover 20 on the antenna. The core 15 serves to lend rigidity to the coil part of the antenna element 10 and avoids extra weight of molding material or the like which might fill the inner void of the coil in certain molding operations.

A base housing 25 covers a mounting structure, preferably a pivotal mounting structure as shown in more detail in subsequent figures. The antenna may be mounted on an automobile or the like through a metallic part of the automobile in a known fashion or adhesively mounted on a glass surface. In the illustrative embodiment of FIG. 1, the antenna is mounted on a glass surface 30. Glass-mounted antennas are well known in the art and the antenna is coupled to circuitry contained, for example, in a housing 28 on the other side of the glass 30 and signals between the electrical circuitry and the antenna are capacitively coupled through the glass 30. Electrical connection is made from the circuit in housing 28 to a mobile radio or the like by means of a coaxial cable 32.

Figure 2:
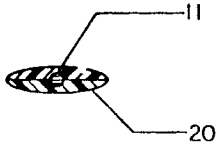
FIG. 2 is an enlarged cross section of the antenna of FIG. 1 along line 2—2.
Figure 3:
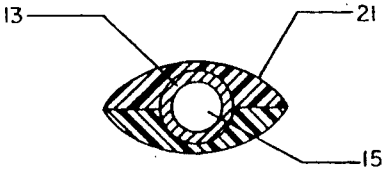
FIG. 3 is an enlarged cross section of the antenna of FIG. 1 along 3—3.

FIG. 2 is an enlarged cross section of the antenna of FIG. 1 along line 2—2. The upper conductive antenna element 11 is shown in FIG. 2 encased in the cover 20. FIG. 3 is an enlarged cross-sectional view along line 3—3 of FIG. 1. Shown in FIG. 3 is the expanded cover section 21 as well as the core 15, centrally positioned within loading coil 13. As will be apparent from the drawing, the elongated cross sections shown in FIGS. 2 and 3 show a comparatively longer longitudinal dimension in the direction of travel of the vehicle thereby providing rigidity in the direction in which bending tends to take place. The elongated cross sections of FIGS. 2 and 3 have a relatively shorter transverse dimension to present a minimal air resistance in the direction of travel while receiving the strengthening benefit of the material in the plastic cover in the longitudinal direction. Shown in FIGS. 2 and 3 is a substantially symmetrical cross section. Numerous other cross-sectional designs may be envisioned which have similar characteristics to those shown in the drawing. These may be especially fashioned to present a unique appearance for marketing appeal.

Instead of covering the upper and lower conductive antenna sections 11 and 12 with a nonconductive cover to provide resistance against bending and provide a more aesthetically pleasing design, a metallic conductive antenna element, such as sections 11 and 12, may be formed in a shape shown in the drawing. Specifically, the antenna element may be provided with the cross section shown in FIG. 2 having a comparatively longer dimension in the direction of travel and a relatively shorter transverse dimension.

Figure 4:
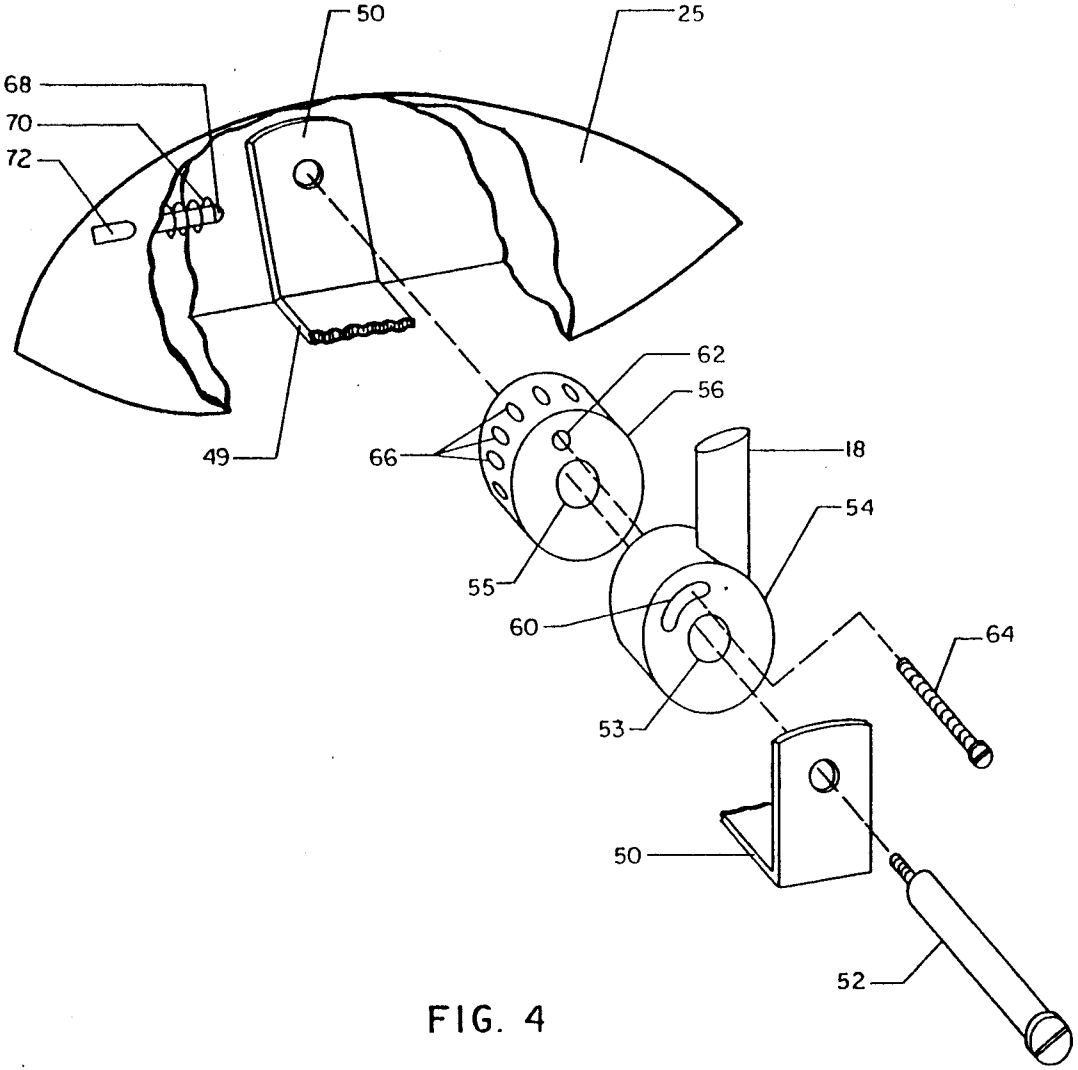
FIG. 4 is an exploded fragmentary perspective view of one embodiment of a pivot support for the antenna of FIG. 1.

FIG. 4 is an exploded fragmentary perspective view of one illustrative pivoting assembly in housing 25. The housing 25 may be provided with a longitudinally extending slot (not shown in the drawing) to allow the antenna 18 to be pivoted to a flattened position without interference from the housing 25. The housing 25 includes a pivot support structure including a generally U-shaped bracket 49 having a pair of pivot support members 50 and a pivot bolt 52. The pivot bolt 52 extends through a central opening 53 of base 54 of the antenna and an aligned central opening 55 of a cylindrically-shaped index collar 56. The antenna base 54 is provided with an elongated slot 60 and the index collar 56 is provided with a threaded opening 62. An adjustment bolt 64 extends through the slotted opening 60 and engages the threaded open 62. The slotted opening 60 is provided with curved surfaces to allow rotational movement of the base 54 relative to the collar 56 when the bolt 64 is extended in the elongated slot 60. The cylindrical index collar 56 is further provided with a plurality of indentations along its circumference. A retractable retaining pin 68 selectively engages the indentations 66 in various rotational positions of the cylindrical collar 56. The retractable retaining pin 68 is drawn into engagement with the index collar 56 by means of a spring 70. One end 72 of the retractable retaining pin 68 extends beyond the outer cover of the housing 25 and the pin may be withdrawn from the index collar 56 against the force of the spring 70 to allow the antenna 18 to be moved to a flat position. The retaining pin 68 may be provided with a rounded end for engagement with indentations 66 in a sliding fashion such that a force of sufficient magnitude against the antenna 18 causes the pin 68 to be moved out of indentations 66 against the force of the spring 70, allowing the antenna to be moved to a flattened position when an obstacle is encountered. In one particular configuration, the index collar is provided with 18 indentations 66 and the slotted opening 60 in antenna base 54 covers at least 20 degrees of rotation to allow for rotational adjustment between the index collar 56 and the base 54 in a range between adjacent indentations.

Figure 5:
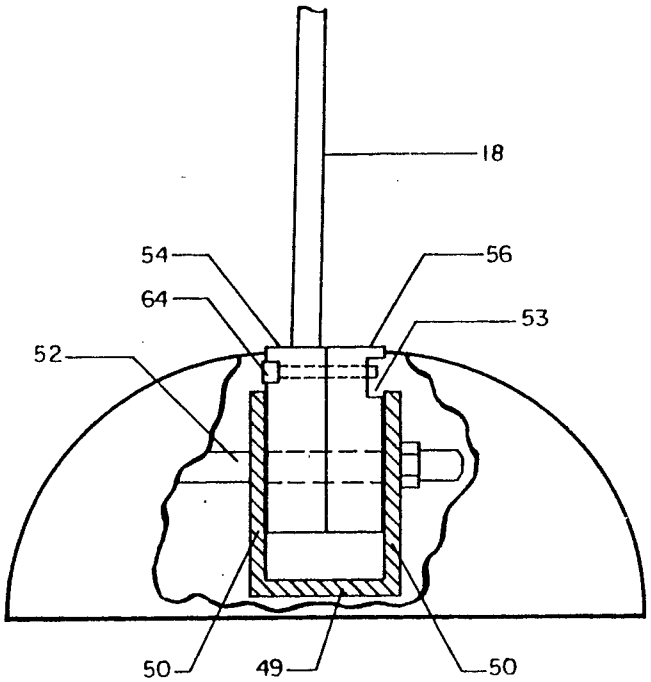
FIG. 5 is a partial cutaway frontal view of the pivot support of FIG. 4.

FIG. 5 is a partial cutaway frontal view of the pivot support of FIG. 4 showing the U-shaped bracket 49, having pivot support members 50, and index collar 56 retained in position with respect to antenna base 54 by means of the adjustment bolt 64. The pivot bolt 52 and adjustment bolts 64 may each be provided with a locking nut.

Figure 6:
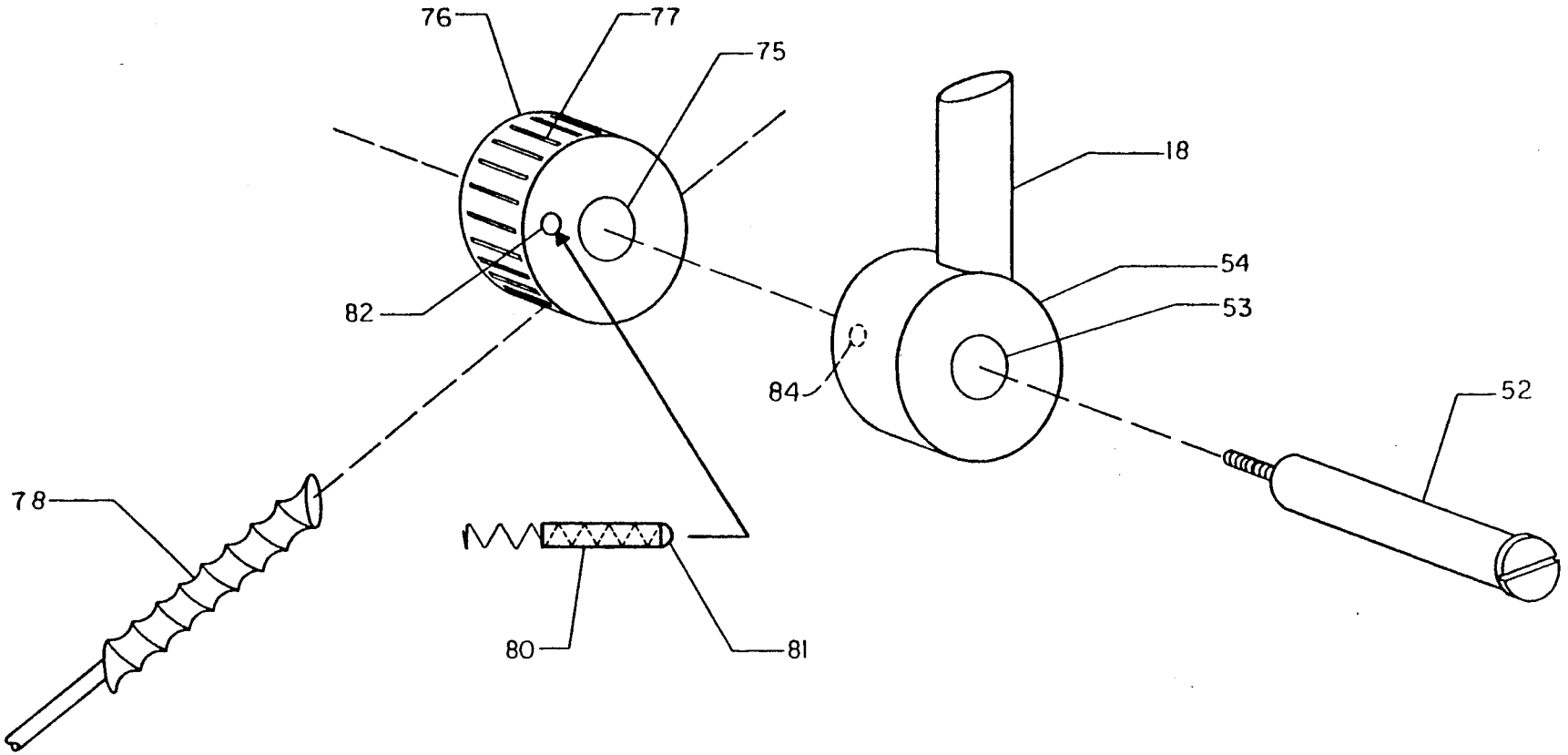
FIG. 6 is a partial exploded perspective view of an alternate embodiment of a pivot support and adjustment arrangement for the antenna of FIG. 1.

FIG. 6 is an alternate embodiment of an adjustable pivot arrangement including the pivot bolt 52 engaging the U-shaped pivot support bracket 49 shown in FIGS. 4 and 5. In the arrangement of FIG. 6, the pivot bolt engages central opening 53 and antenna base 54 which is aligned with central opening 75 in cylindrical collar 76. The cylindrical collar 76 is provided with transversely extending grooves 77 along its circumference for engagement with a worm gear 78. Rotation of the worm gear 78 causes the collar 76 to be rotated and specifically provides for fine rotational adjustment of the collar 76. A position-retaining detent comprises a spring-loaded shaft 80 having a curved end 81, positioned in a lateral passage 82 in the collar 76, and an indentation 84 in antenna base 54 which engages the rounded end 81. When in a near upright position in which the rounded end 81 is engaged in the indentation 84, the antenna may be adjusted to a precise upright position by rotation of the worm screw 78. By overcoming the force of the detent, the antenna 18 may be moved to a flat position, and when it is returned to the detent engagement position, it will have been returned to the precise position obtained by adjustment with the worm screw 78.

Figure 7:
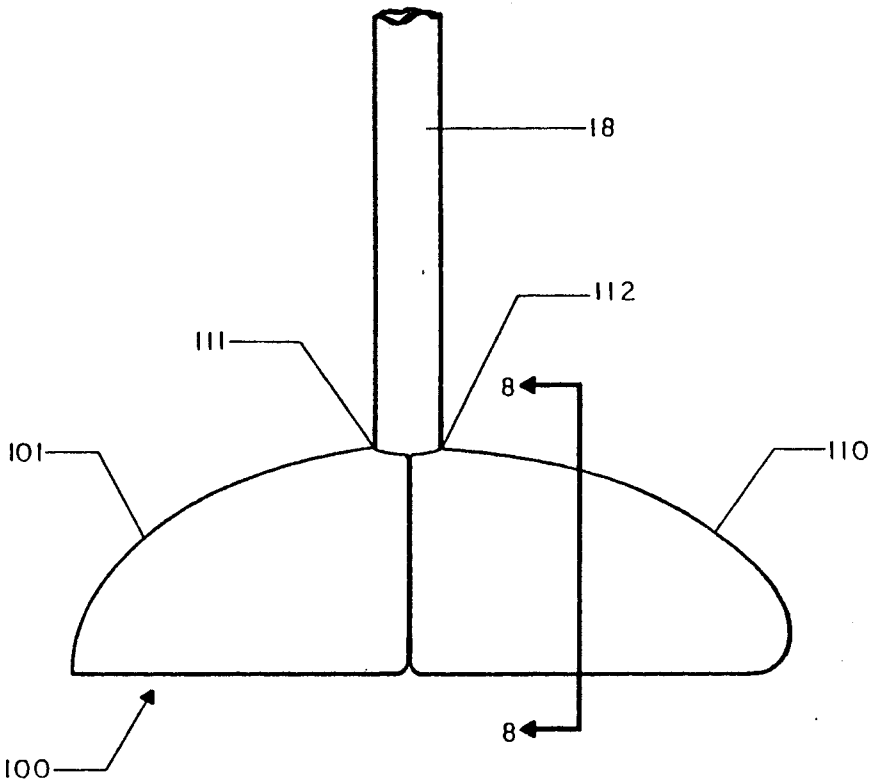
FIG. 7 is a side elevation of an alternate embodiment of a pivot support for the antenna of FIG. 1.
Figure 10:
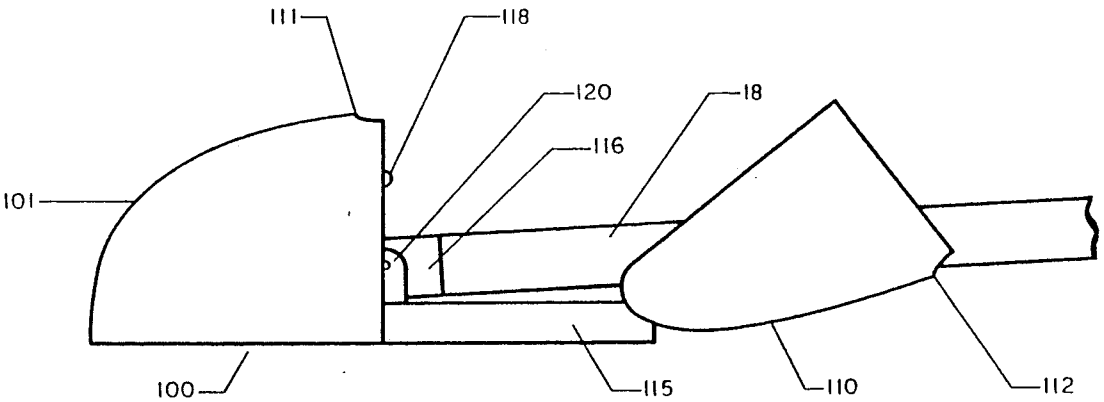
FIG. 10 is a side elevation of the pivot support arrangement of FIG. 7 with the antenna in a flat position.

FIG. 7 represents an alternate embodiment of an antenna mounting and pivot arrangement having a housing 100 comprising a stationary part 101 and a movable part 110 containing an adjustable pivot support. The base of the antenna 18 is pivoted on the internal pivot support and the antenna is maintained in an upright position by means of end stops 111 and 112 integral to the stationary part 101 and the movable part 110, respectively. FIG. 10 is a side view of the housing 100 with the movable part 110 pivoted to an open position and the antenna 18 pivoted to a flattened position. Movable part 110 is shown opened to a back position in FIG. 10. Other movable part arrangements, such as a side opening cover, may be readily envisioned. Shown in FIG. 10 is a rail section 115 to which the movable part 110 is pivotally attached. The antenna is provided with a base part 116 pivotally supported in pivot support 120. Pivot support 120 is slidably supported on the rail 115. A detent including a spring-loaded pin 118 in the stationary part 101 provides a latching engagement between the movable part 110 and the stationary part 101.

Figure 8:
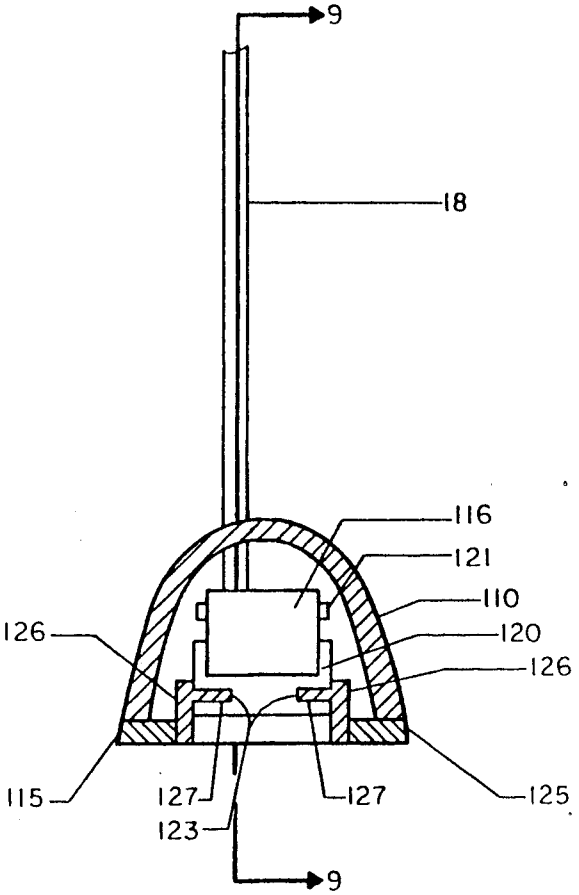
FIG. 8 is a cross-sectional view along line 8—8 of FIG. 7.

FIG. 8 is a cross-sectional view of the housing 100 along line 8—8 of FIG. 7. The antenna mounting housing 100 may be attached to an automotive vehicle in the same manner as described with respect to FIG. 1 and may, for example, be adhesively positioned on a window glass (not shown in the drawing) and capacitively coupled to suitable electronic circuitry. As shown in FIG. 8, the antenna base 116 is pivotally supported on pivot support 120 by means of a pivot pin 121. The pivot support 120 is provided with opposing horizontal slots 123 and slidably engages rail members 115 and 125. Each of the rail members 115, 125 is provided with riser sections 126 having horizontally extending flanges 127 for engagement with the horizontally extending slots 123 of the pivot support 120.

Figure 9:
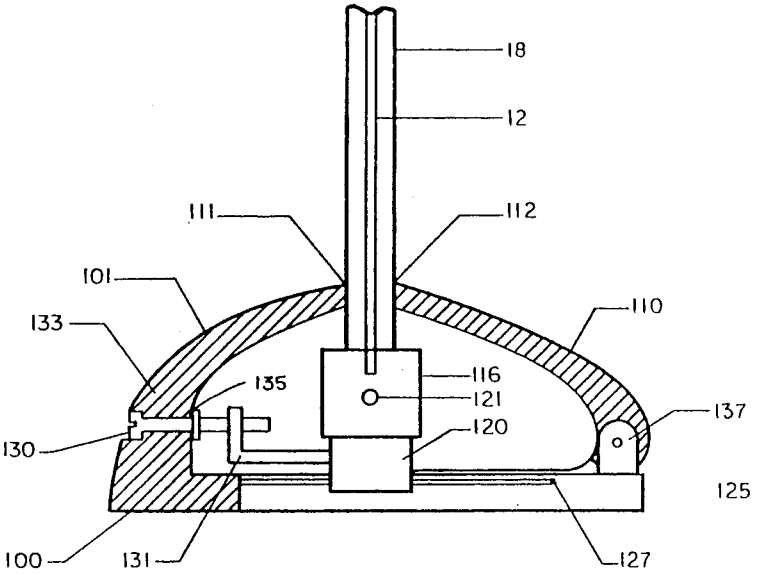
FIG. 9 is a cross-sectional view along line 9—9 of FIG. 8.

FIG. 9 is a cross-sectional view of the housing 100 along line 9—9 of FIG. 8. FIG. 9 shows antenna base 116 pivotally supported by pin 121 on pivot support 120. An adjusting screw 130 acting against a shoulder 133 of the stationary part 101 at one end thereof and against a retaining ring 135 at the other end thereof, threadably engages bracket 131 attached to pivot support 120. Rotational movement of the adjusting screw 130 is translated into linear movement of the pivot support 120 along horizontal flanges 127 of rails 125 and 115 (not shown in FIG. 9). Adjustment of the antenna 18 with respect to a vertical direction is obtained when the antenna 18 is forced against end stops 111, 112 by linear motion of the pivot support 120. Pivot flange 137 is one of a pair of flanges on rails 115, 125 for pivotally supporting the movable part 110.

The lower conductive element 12 of the antenna 18 threadably engages antenna base 116 which is preferably a conductive metallic base. Metallic pivot pin 121 extends through the base 116 to a conductive metallic pivot support 120 having a lower end 128 positioned immediately adjacent a window glass on which the antenna is mounted. In this manner, a conductive path is established between the element 12 and stationary part 101, and signals may be transmitted to appropriate electrical circuitry capacitively coupled through window glass or the like.

Figure 11:
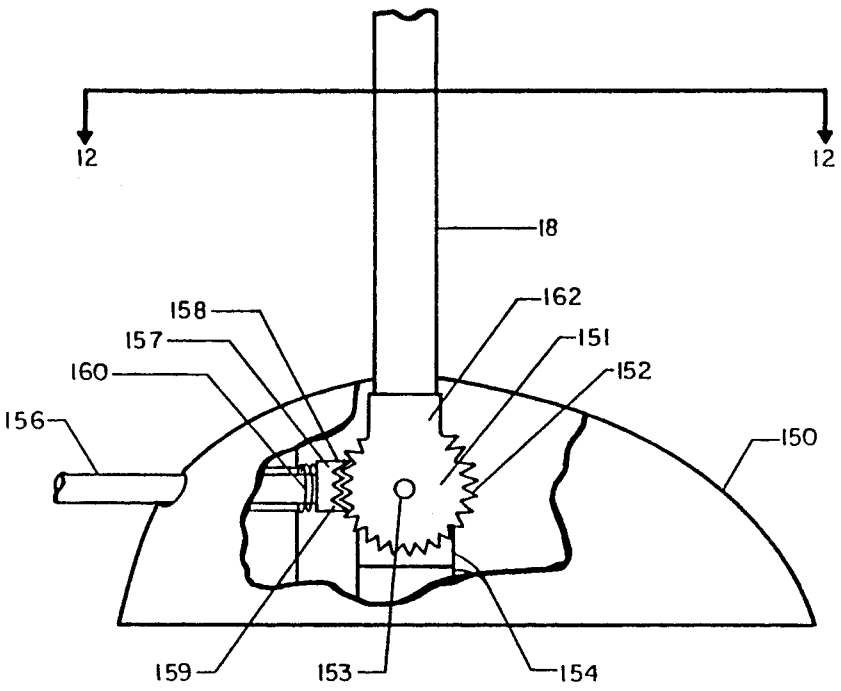
FIG. 11 is a fragmentary cutaway side elevation of a pivot support and upright orientation adjustment mechanism for the antenna of FIG. 1.

FIG. 11 represents an alternate embodiment of an antenna mounting and pivot arrangement comprising a housing 150 which may be mounted on an automotive vehicle in a standard fashion. The antenna 18 is provided with a conductive base 151 having a concave curved circumferential surface provided with a plurality of transversely extending adjacent grooves or teeth 152. The base 151 is pivotally supported by means of pivot pin 153 engaging pivot supports 154. A retractable adjustment pin 156 is provided with an enlarged end piece 157 having a convex surface generally matching the outer surface of base 151 and a plurality of transversely extending grooves or teeth 159 for engagement with grooves 152 of base 151. The end piece 157 of the retractable pin 156 is forced against the base 151 by the force of a spring 160. In the embodiment of FIG. 11, the base 151 is essentially cylindrical in shape and is provided with a flattened extension portion 162 for attachment of the base to the antenna 18. The antenna 18 comprises a conductive element (not shown in the drawing) connected to metallic base 151, and a conductive path may be established to the housing 150 through the pivot pin 153 and pivot supports 154. Housing 150 may, for example, be mounted on glass and antenna signals may be capacitively coupled through the glass.

FIG. 11 shows the retractable pin 156 in a partially retracted position to better illustrate the convex surface 158 and teeth 159. In one particular embodiment, the cylindrical part of the base 151 has a circumference of approximately three inches and is provided with 30 substantially evenly spaced grooves, or one groove every 12 degrees of the circumference. The end surface 158 is provided with similarly spaced grooves 159 for engagement with the grooves 152. By way of example, the end surface 158 may cover a circumferential distance of 60 degrees of the base 151 and provided with five grooves 159 for engaging five grooves 152 on base 151, each spaced apart by 12 degrees. It will be appreciated that the enlarged area of engagement between the end piece 157 and the base 151 provides enhanced resistance to rotation of the base 151 and antenna 18. The specific dimensions are not critical and larger or smaller areas of engagement between the two surfaces may be used as desired. Providing adjustment grooves 152 which are separated by 12 degrees, as in this illustrative embodiment, allows adjustment of the antenna to plus or minus six degrees from any particular desired position.

Figure 12:
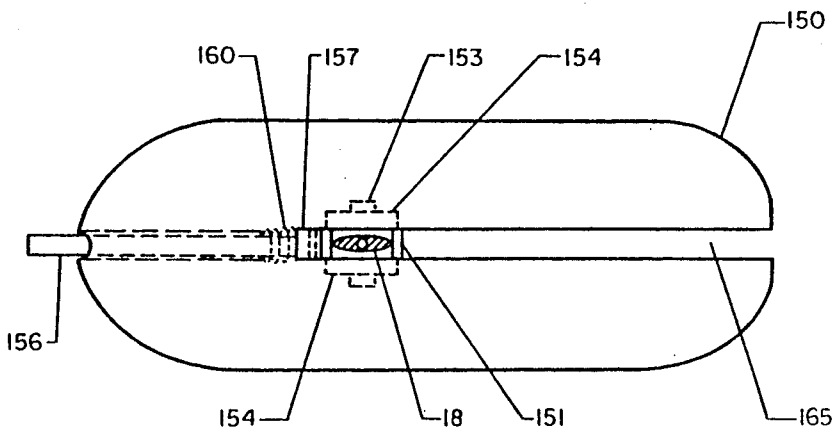
FIG. 12 is a cross-sectional view along line 12—2 of FIG. 11.
Figure 13:
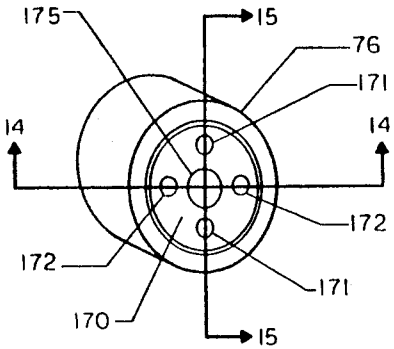
FIG. 13 is a frontal elevation of an antenna adjustment collar for use in the arrangement of FIG. 6.

FIG. 12 is a cross-sectional view along line 12—12 of FIG. 11 showing a cross section of the antenna 18 and a top view of the housing 150. Devices shown in the cutaway view of FIG. 11 are shown in phantom in FIG. 12. FIG. 12 further shows that the housing 150 is provided with a longitudinally extending slot along the centerline of the housing and to one side of the pivot supports 154 to accommodate antenna 18 as it is pivoted from the upright position shown in FIG. 11. In the configuration of FIGS. 11 and 12, the end surface 158 of pin 156 engages grooves 152 on an antenna base 151 attached to antenna 18. The antenna base may be constructed with a stationary adjustment collar in a manner depicted in FIG. 6 and engaging a rotating antenna base part by means of a detent in a manner depicted in FIG. 6 or by means of a retainer disk as depicted in FIG. 13. The end surface 158 of pin 156 may then engage grooves, like grooves 152, on the adjustment collar. The advantage of such an arrangement is that the antenna may be adjusted to a preferred position and readily returned to the previously adjusted position.

Figure 14:
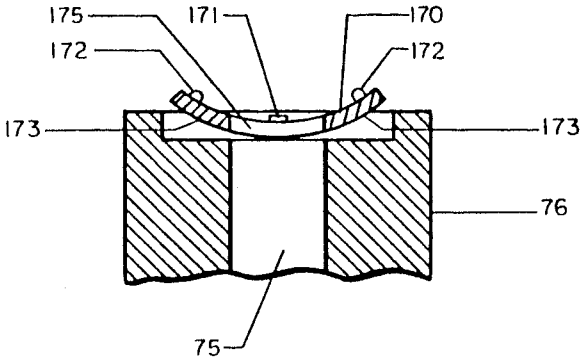
FIG. 14 is a cross-sectional view along line 14—14 of FIG. 13.
Figure 15:
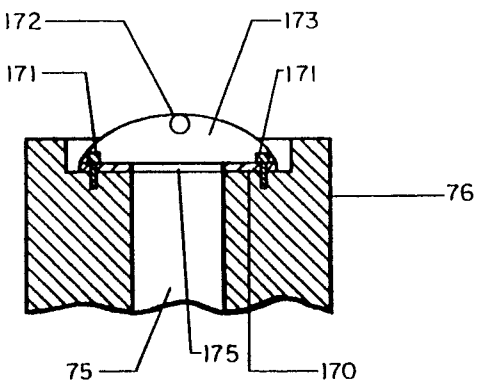
FIG. 15 is a cross-sectional view along line 15—15 of FIG. 13.

FIG. 13 shows an alternate engagement retainer arrangement for engagement of an adjustment collar such as collar 76 with an antenna base 54, both supported on a pivot bolt 52, as shown in FIG. 6. Instead of a spring-loaded shaft 80 shown in FIG. 6, a retainer disk 170 is used as shown in FIG. 13. Disk 170 may be a substantially circular disk fabricated of spring steel and provided with protuberances 172 for engagement with one or more indentations 84 in antenna base 54 shown in FIG. 6. It is provided with a central opening 175 to accommodate pivot bolt 52. Disk 170 is curved along a centerline such that a central portion of the disk engages a substantially flat frontal face of collar 76 and is attached by means of attachment rivets 171 to disk 170. As shown in FIGS. 14 and 15, a pair of protuberances 172 are mounted on opposite ends of curved sections 173. These protuberances may, for example, be round head rivets for engagement with a corresponding pair of indentations of antenna base 54 shown in FIG. 6.

It will be understood that the above description is only illustrative of the principles of the invention and that numerous other configurations can be devised by those skilled in the art without departing from the spirit and scope of the invention.

What is claimed is:

1. An antenna for use on an automotive vehicle comprising:

a conductive antenna element having a lower end;

an antenna base connected to said lower end and having a central opening;

a cylindrical collar for defining a preferred position for said conductive antenna element and having a central opening in alignment with said central opening in said base, said collar disposed adjacent said base and in engagement with said base and comprising a plurality of circumferentially spaced-apart indentations;

an antenna pivot support for pivotally supporting said base and said collar; and a position adjustment device comprising a retractable retaining pin for engaging said indentations for allowing pivoting movement of said antenna when said pin is in a retracted position and for positioning said antenna in a selected upright orientation when said pin is in engagement with a predetermined one of said indentations.

2. The antenna in accordance with claim 1 and further comprising a position adjustment screw and wherein said base comprises a slotted opening and said collar comprises a threaded opening, said screw extending through said slotted opening and engaging said threaded opening, thereby allowing rotational adjustment of said base relative to said collar.

3. An antenna for use on an automotive vehicle comprising:

a conductive antenna element having a lower end;

a base connected to said lower end and having a central opening;

a cylindrical collar for defining a preferred position of said conductive antenna element and having a central opening in linear alignment with said central opening in said base, said collar disposed adjacent said base and in engagement with said base;

an antenna pivot support for pivotally supporting said base and said collar;

an adjustment screw engaging the circumference of said collar for selectively positioning said collar in predetermined rotational orientations; and a detent for selectively maintaining said base in engagement with said collar and allowing rotation of said base relative to said collar in the presence of a rotational force applied to said base;

whereby said base may be disengaged from said collar so that said antenna can be pivoted to a flat position and returned to a predefined upright position defined by said collar and said predefined upright position may be selectively altered by rotation of said adjustment screw.

4. An antenna for use on an automotive vehicle comprising:

a conductive antenna element;

a base connected to one end of said conductive element, and said base having a central opening;

a pivot support including a pivot pin engaging said central opening for pivotally supporting said antenna;

a first end stop for engaging one edge of said antenna at a position above said central opening;

a second, removable, end stop engaging another edge of said antenna opposite said one edge, at a position above said central opening and allowing said antenna to pivot on said pivot support upon removal of said second end stop;

a pivot support base for slidably engaging said pivot support; and a positioning screw engaging said pivot support for selectively positioning said pivot support on said base to adjust upright orientation of said antenna by movement of said pivot support relative to said first and second stops.

5. The antenna in accordance with claim 4 and further comprising a cover housing for covering said pivot support and wherein said first and said second stops are formed integral to said cover housing.

6. The antenna in accordance with claim 5 wherein said cover housing comprises a stationary part and a movable part pivotally attached to said pivot support base, and wherein said first end stop is formed integral with said stationary part and said second end stop is formed integral with said movable part.

7. An antenna for use on an automotive vehicle comprising:

an upwardly extending conductive element;

a substantially cylindrically-shaped base connected to a lower end of said conductive element, said base having a convex curved circumferential outer surface and a longitudinal axis extending substantially perpendicular to said upwardly extending conductive element and a central opening in said base extending in substantially linear alignment with said longitudinal axis and a plurality of spaced apart circumferential indentations on said outer surface;

an antenna pivot support for pivotally supporting said base, and comprising a pivot pin engaging said central opening; and a retractable antenna adjustment pin disposed generally along a line extending substantially perpendicular to said pivot pin for selectively engaging said indentations to maintain said antenna at selected ones of a plurality of discrete adjustment positions.

8. An antenna for use on an automotive vehicle adapted for traveling in a preferred direction and comprising:

substantially straight upper and lower conductive antenna elements of substantially equal diameter and an antenna loading coil having a diameter greater than said diameter of said conductive antenna elements and connected between said upper and said lower conductive antenna elements;

a substantially inflexible nonconductive covering formed continuously around said upper conductive antenna element and said loading coil and said lower conductive antenna element;

said covering having a first elongated cross section around said upper and lower conductive antenna elements and a second elongated cross section around said loading coil;

said first cross section having a longitudinal dimension in said preferred direction and a transverse dimension, shorter than said longitudinal dimension, in a direction transverse to said preferred direction and said second cross section having a longitudinal dimension in said preferred direction substantially greater than said longitudinal dimension of said first cross section and having a transverse dimension, shorter than said longitudinal dimension of said second cross section, in said transverse direction substantially greater than said transverse dimension of said first cross section;

whereby said covering provides resistance to bending of said antenna along a line corresponding to said preferred direction while presenting a low wind resistance.

9. The antenna in accordance with claim 8 wherein said antenna loading coil comprises an inner spatial area and said antenna further comprises a nonconductive core inserted in said inner spatial area.

10. The antenna in accordance with claim 8 and further comprising:

a cylindrically-shaped base connected to one end of said lower conductive antenna element, said base comprising a central opening and a convex curved circumferential outer surface and a plurality of transversely extending grooves on said curved surface;

an antenna pivot support for pivotally supporting said base through said central opening; and an adjustment pin having an end surface having a plurality of grooves releasably engaging said grooves on said curved surface of said base, whereby said antenna may be adjusted to different upright orientations by selective disengagement and engagement of said end surface of said adjusting pin with said curved surface of said base.

11. The antenna in accordance with claim 10 wherein said end surface of said adjustment pin is maintained in engagement with said curved surface of said base by the force of a spring applied to said pin.

12. The antenna in accordance with claim 10 wherein said end surface comprises a concave curved surface and said grooves of said adjustment pin are disposed on said concave curved surface.

13. The antenna in accordance with claim 8 wherein said first and second cross sections each comprise a longitudinal centerline extending in said preferred direction and a transverse centerline in said transverse direction, and wherein said first and said second cross sections are each substantially symmetrical about said longitudinal and said transverse centerlines.

14. The antenna in accordance with claim 8 and further comprising an antenna mounting base connected to said lower antenna element for mounting said antenna on said vehicle and an antenna mounting housing covering a lower portion of said lower antenna element and said mounting base, said housing having a curved outer shell sloping away from said lower antenna element in said preferred direction and in said transverse direction.

15. The antenna in accordance with claim 8 and further comprising:

a base connected to one end of said lower conductive antenna element, said base having a central opening;

a cylindrical collar for defining a preferred position for said lower conductive antenna element and having a central opening in linear alignment with said opening in said base, said collar disposed adjacent said base and in engagement with said base;

an antenna pivot support including a pivot pin engaging said central opening of said base and said central opening of said collar in a linearly aligned direction.

16. The antenna in accordance with claim 15 wherein said base and said collar comprise adjacent end surfaces, and further comprising a circularly-shaped retainer disk disposed between said end surfaces of said collar and said base and said end surface of said base comprising at last one recess and said disk engaging said end surface of said collar along a centerline of said disk and comprising a plurality of protuberances disposed adjacent at least one edge of said disk and removed from said centerline for engaging said recess.

17. The antenna in accordance with claim 16 wherein said end surface of said collar comprises a centrally disposed recess and wherein said disk is at least partially contained within said centrally disposed recess and said disk further comprising curved ends extending at least partially beyond said centrally disposed recess and said protuberances are disposed adjacent said curved ends.

18. The antenna in accordance with claim 8 and further comprising a substantially cylindrically-shaped base connected to a lower end of said lower conductive antenna element and having a central opening;

an antenna pivot support for pivotally supporting said base, and comprising a pivot pin engaging said central opening; and an adjustment pin disposed generally along a line extending substantially perpendicular to said pivot pin and engaging said cylindrically-shaped base for retaining said lower conductive antenna element in a selected adjustment position.

19. The antenna in accordance with claim 18 wherein said base comprises a circumferential outer surface and said adjustment pin comprises a worm gear adjustment screw engaging said outer surface for rotationally adjusting said antenna to any of a plurality of adjustment positions.

20. The antenna in accordance with claim 18 wherein said base comprises a circumferential outer surface and a plurality of transversely extending grooves on said outer surface, said adjustment pin comprising a concave end surface having a plurality of grooves releasably engaging said grooves on said outer surface to maintain said lower conductive antenna element at selected ones of a plurality of discrete adjustment positions.

* * * * *